US011300985B2

(12) United States Patent
Fort

(10) Patent No.: US 11,300,985 B2
(45) Date of Patent: Apr. 12, 2022

(54) VOLTAGE REGULATOR

(71) Applicant: STMicroelectronics (Rousset) SAS, Rousset (FR)

(72) Inventor: Jimmy Fort, Puyloubier (FR)

(73) Assignee: STMicroelectronics (Rousset) SAS, Rousset (FR)

( * ) Notice: Subject to any disclaimer, the term of this patent is extended or adjusted under 35 U.S.C. 154(b) by 0 days.

(21) Appl. No.: 17/070,304

(22) Filed: Oct. 14, 2020

(65) Prior Publication Data

US 2021/0124380 A1 Apr. 29, 2021

(30) Foreign Application Priority Data

Oct. 23, 2019 (FR) ..... 1911832

(51) Int. Cl.

| | |
|---|---|
| ***G05F 1/56*** | (2006.01) |
| ***G05F 1/575*** | (2006.01) |
| ***G05F 1/565*** | (2006.01) |
| ***G05F 1/46*** | (2006.01) |
| ***G05F 1/445*** | (2006.01) |

(52) U.S. Cl.

CPC ..... *G05F 1/445* (2013.01); *G05F 1/461* (2013.01)

(58) Field of Classification Search

CPC ..... G05F 1/575; G05F 1/565; G05F 1/462; G05F 1/468; G05F 1/56

See application file for complete search history.

(56) References Cited

U.S. PATENT DOCUMENTS

| | | | | |
|---|---|---|---|---|
| 10,152,072 | B1 * | 12/2018 | Elhebeary | G05F 1/565 |
| 10,591,938 | B1 * | 3/2020 | Golara | H03F 3/45183 |
| 2010/0090667 | A1 | 4/2010 | Gleason et al. | |
| 2015/0077183 | A1 | 3/2015 | Ciubotaru | |
| 2015/0355653 | A1 * | 12/2015 | Drebinger | H03F 3/34 323/280 |
| 2019/0235543 | A1 | 8/2019 | Chen et al. | |
| 2021/0124380 | A1 | 4/2021 | Fort | |
| 2021/0124384 | A1 * | 4/2021 | Fort | G05F 1/575 |

FOREIGN PATENT DOCUMENTS

| | | | |
|---|---|---|---|
| CN | 105005351 | A | 10/2015 |
| CN | 107544613 | A | 1/2018 |
| CN | 213634248 | U * | 6/2021 |

OTHER PUBLICATIONS

English translation of CN 213634248 ,HU B,Reinforced Buffer Low Regulate Circuit Current Source End Connect Input Voltage Grounded Latter (Year: 2021).*

(Continued)

*Primary Examiner* — Sisay G Tiku
(74) *Attorney, Agent, or Firm* — Crowe & Dunlevy

(57) ABSTRACT

A device includes a current source, a first transistor connected between a first supply rail and an output terminal, and a second transistor connected between the output terminal and a first terminal of the current source, wherein a second terminal of the current source is connected to a second supply rail. A variable-gain amplifier circuit responds to a potential at the first terminal of the current source by applying a potential to the control terminal of the first transistor. A gain of the amplifier circuit is determined by a potential at the output terminal.

22 Claims, 4 Drawing Sheets

(56) References Cited

OTHER PUBLICATIONS

Mahender Manda et al: "A mutli-Loop Low-Dropout FVF Volatge Regulator with Enhanced Load Regulation (Invited Paper)", Dec. 31, 2017 (Dec. 31, 2017) XP055710822.
Tsz Yin Man et al: "A high Slew-Rate Push-Pull Output Amplifier for Low-Quiescent Current Low-Dropout Regulators With Transient-Response Improvement", IEEE Transactions on Circuits and Systems II: Express Briefs, IEEE, US, vol. 54, N° 9, Sep. 1, 2007 (Sep. 1, 2007), pp. 755-759, XP011192256.
INPI Search Report and Written Opinion for FR 1911832 dated Jul. 6, 2020 (9 pages).

* cited by examiner

VOLTAGE REGULATOR

PRIORITY CLAIM

This application claims the priority benefit of French Application for Patent No. 1911832, filed on Oct. 23, 2019, the content of which is hereby incorporated by reference in its entirety to the maximum extent allowable by law.

TECHNICAL FIELD

The present disclosure generally concerns electronic systems and circuits, particularly voltage regulators, and more particularly low drop-out (LDO) regulators.

BACKGROUND

LDO regulators are used in electronic systems to deliver a power supply potential to various elements (memories, processing circuits, etc.) of these electronic systems. Such LDO regulators are configured to deliver, from an electric power supply source, a constant power supply potential (DC) having its value determined by a set point signal.

However, the value of the power supply potential delivered by such regulators may vary and diverge from its set point value. This is particularly true during variations of the current drawn by one or a plurality of elements, or loads, powered by the regulator, such a phenomenon being currently referred to in the art as load transient. This is also true during variations of the power supply voltage delivered to such regulators by electric power supply sources, such a phenomenon being currently referred to in the art as line transient.

There is a need in the art for a voltage regulator that can deliver a constant power supply potential having its value diverging as little as possible from a set point value. There particularly is a need for a voltage regulator capable of taking the value of the power supply potential that it delivers back to the set point value, as fast as possible after a load or line transient.

SUMMARY

Embodiments herein overcome all or part of the disadvantages of known voltage regulators, particularly of know LDO regulators.

According to a first aspect, an embodiment provides a device comprising: a first transistor connected between a first node and an output terminal of the device coupled to a first rail of application of a first potential; a first current source connected between the first node and a second rail of application of a second potential; and a first circuit comprising: a second current source connected between the second rail and a second node; an operational amplifier having a non-inverting input configured to receive a potential set point; and a second transistor connected between the second node and an inverting input of the operational amplifier coupled to the first rail, a control terminal of the second transistor being connected to an output of the operational amplifier and to a control terminal of the first transistor.

According to an embodiment, in steady state: a current flowing through the first transistor determines a first voltage between the control terminal of the first transistor and the output terminal; and a current flowing through the second transistor determines a second voltage between the control terminal of the second transistor and the inverting input of the operational amplifier, the first circuit being configured so that the first and second voltages are equal.

According to an embodiment, the first and second transistors are identical, the device being configured so that, in steady state, identical currents cross the first and second transistors.

According to an embodiment, the device comprises no direct electric connection between the second node and the control terminal of the second transistor.

According to an embodiment, in steady state, the first circuit is configured to impose a potential on the second node equal to the potential on the first node.

According to an embodiment, the first circuit further comprises: a third current source connected between the first rail and the inverting input of the operational amplifier; and a third transistor and a resistive element, preferably a fourth diode-connected transistor, series-connected between the second node and the first rail, a control terminal of the third transistor being configured to receive a bias potential and a conduction terminal of the third transistor being connected to the second node.

According to an embodiment, in steady state, the second current source, the third current source, and the bias potential received by the control terminal of the third transistor determine the potential of the second node.

According to an embodiment, the device further comprises: a fifth transistor connected between the output terminal and the first rail; and an amplifier circuit configured to control the fifth transistor based on the potential of the first node.

According to an embodiment, the gain of the amplifier circuit is determined by the potential on the output terminal.

According to an embodiment, in steady state, the amplifier circuit and the first circuit are configured so that the second node and the first node are at the same potential.

According to an embodiment, the amplifier circuit comprises a fourth current source connected between a control terminal of the fifth transistor and the first rail, and a sixth transistor connected between the first node and the control terminal of the fifth transistor, a control terminal of the sixth transistor being configured to receive a bias potential.

According to an embodiment, in steady state, the first current source, the fourth current source, and the bias potential received by the control terminal of the sixth transistor determine the potential of the first node.

According to an embodiment, a current delivered by the fourth current source has a value determined by the potential of the output terminal.

According to an embodiment, the described device forms a voltage regulator.

According to the first aspect, another embodiment provides an electronic system comprising a device such as described, preferably wherein said device is implemented by a single integrated circuit, and preferably wherein the device comprises no capacitor connected between the output terminal and the second rail.

According to a second aspect, an embodiment provides a device comprising: a first transistor connected between a rail of application of a first potential and an output terminal of the device; a second transistor connected between the output terminal and a first terminal of a first current source, a second terminal of the first current source being connected to a rail of application of a second potential; and a variable-gain amplifier circuit configured to deliver a potential to a control terminal of the first transistor based on a potential available on the first terminal of the first current source, the gain of the amplifier circuit being determined by a potential on the output terminal.

According to an embodiment, the variable-gain amplifier circuit comprises: a third transistor connected between the first terminal of the first current source and the control terminal of the first transistor; and a second variable current source connected between the rail of application of the first potential and the control terminal of the first transistor, the second current source being configured to deliver a variable current having its value depending on the potential on the output terminal.

According to an embodiment, a control terminal of the third transistor is connected to a node of application of a bias potential.

According to an embodiment, the device further comprises a first circuit configured to deliver a control signal to the second current source, and to determine the control signal of the second current source based on the potential on the output terminal.

According to an embodiment, the first circuit comprises: a fourth transistor in a current mirror with a fifth transistor; a sixth transistor connected to the output terminal and in series with the fifth transistor, a control terminal of the sixth transistor being connected to a control terminal of the second transistor; and a seventh transistor series-connected with the fourth transistor between the rail of application of the first potential and the rail of application of the second potential.

According to an embodiment, the second current source comprises an eighth transistor in a current mirror with the seventh transistor.

According to an embodiment, the device further comprises a second circuit configured to deliver a control signal to the second transistor.

According to an embodiment, the second circuit is configured to determine the control signal of the second transistor based on a set point value of the potential on the output terminal.

According to an embodiment, the second circuit comprises: an operational amplifier having a first input configured to receive a potential representative of said set point value; and a ninth transistor having a first conduction terminal coupled to the rail of application of the second potential via a third current source, having a second conduction terminal connected to a second input of the operational amplifier, and having a control terminal configured to deliver the control signal of the second transistor.

According to an embodiment, the second circuit further comprises a tenth transistor having a first conduction terminal connected to the second conduction terminal of the ninth transistor, having a second conduction terminal connected to the rail of application of the first potential, and having its control terminal connected to an output of the operational amplifier.

According to an embodiment, the control terminal of the ninth transistor and the first conduction terminal of the ninth transistor are interconnected, the first input of the operational amplifier being an inverting input.

According to an embodiment, the second circuit further comprises: a fourth current source connected between the second conduction terminal of the ninth transistor and the rail of application of the first potential; and a tenth transistor and a resistive element, preferably an eleventh diode-connected transistor, series-connected between the first conduction terminal of the ninth transistor and the rail of application of the first potential, a control terminal of the tenth transistor being configured to receive a bias potential and being preferably connected to the control terminal of the third transistor, and a conduction terminal of the tenth transistor being connected to the first conduction terminal of the ninth transistor.

According to an embodiment, the second circuit is configured to impose a same potential on the first terminal of the first current source and on the first conduction terminal of the ninth transistor.

According to an embodiment, the device forms a voltage regulator.

Another embodiment provides an electronic system comprising a device such as described, preferably wherein said device is implemented by a single integrated circuit, and preferably wherein the device comprises no capacitor connected between the output terminal and the rail of application of the second potential.

BRIEF DESCRIPTION OF THE DRAWINGS

The foregoing and other features and advantages will be discussed in detail in the following non-limiting description of specific embodiments in connection with the accompanying drawings, wherein.

DETAILED DESCRIPTION

Figure 1:
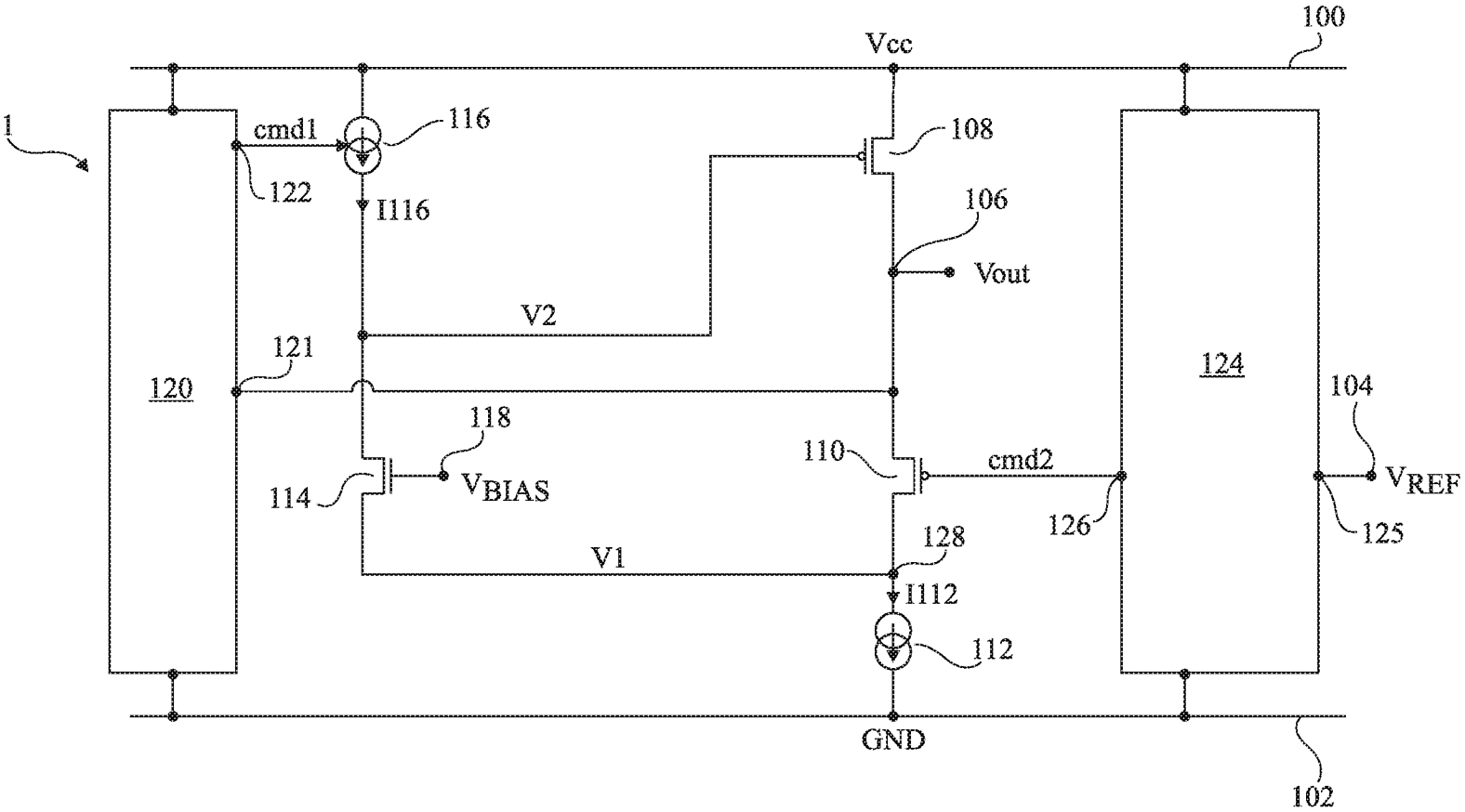
FIG. 1 shows an embodiment of a voltage regulator.

The same elements have been designated with the same reference numerals in the different drawings. In particular, the structural and/or functional elements common to the different embodiments may be designated with the same reference numerals and may have identical structural, dimensional, and material properties.

For clarity, only those steps and elements which are useful to the understanding of the described embodiments have been shown and are detailed. In particular, the various electronic systems where a voltage regulator may be provided, particularly a LDO regulator, have not been detailed, the described embodiments being compatible with usual electronic systems comprising a voltage regulator, particularly a LDO regulator.

Throughout the present disclosure, the term "connected" is used to designate a direct electrical connection between circuit elements with no intermediate elements other than conductors, whereas the term "coupled" is used to designate an electrical connection between circuit elements that may be direct, or may be via one or more other elements.

In the following description, when reference is made to terms qualifying absolute positions, such as terms "front", "back", "top", "bottom", "left", "right", etc., or relative positions, such as terms "above", "under", "upper", "lower", etc., or to terms qualifying directions, such as terms "horizontal", "vertical", etc., unless otherwise specified, it is referred to the orientation of the drawings.

The terms "about", "approximately", "substantially", and "in the order of" are used herein to designate a tolerance of plus or minus 10%, preferably of plus or minus 5%, of the value in question.

FIG. 1 illustrates an embodiment of a voltage regulator 1, and more particularly of a LDO regulator.

Regulator 1 is connected between a power supply rail, or node or line, 100 intended to receive a first potential, or power supply potential, Vcc, and a power supply rail 102 intended to receive a second potential, or reference potential, typically ground GND. In operation, regulator 1 is powered with potential Vcc, for example, a positive potential referenced with respect to ground GND.

Regulator 1 comprises an input terminal 104. Terminal 104 is configured to receive a signal $V_{REF}$, for example, a potential referenced to ground GND, representative of a set point value of a potential Vout delivered by regulator 1 on its output terminal 106. Loads (not shown) are connected to terminal 106 to be powered with potential Vout. The loads may be modeled by a resistor and a capacitor connected in parallel, between terminal 106 and rail 102.

Regulator 1 comprises a MOS transistor 108, preferably a PMOS transistor. Regulator 1 comprises a MOS transistor 110, preferably a PMOS transistor. Regulator 1 comprises a current source 112. Current source 112 is configured to deliver a constant current 1112.

Transistors 108 and 110 and current source 112 are series-connected between rails 100 and 102. Transistor 108 is connected to rail 100, current source 112 being connected to rail 102 and transistor 110 being connected between transistor 108 and current source 112.

More particularly, in the shown example, transistor 108 has a first conduction terminal, in the present example its source, connected to rail 100 and a second conduction terminal, in the present example its drain, connected to terminal 106. Transistor 110 has a first conduction terminal, in the present example its source, connected to output terminal 106 and a second conduction terminal, in the present example its drain, connected to a terminal of current source 112, the other terminal of current source 112 being connected to rail 102.

A control terminal of transistor 110, here its gate, receives a signal or potential cmd2 representative of the set point value of potential Vout. Transistor 110 is controlled by potential cmd2 so that potential Vout is at its set point value in steady state, that is, for example, in the absence of a variation of the current drawn by the loads connected to terminal 106 and of a variation of the potentials on rails 100 and 102.

Regulator 1 further comprises a MOS transistor 114, preferably an NMOS transistor, and a current source 116.

Transistor 114 has a first conduction terminal, in the present example its source, connected to a node 128 of connection between current source 112 and transistor 110, a second conduction terminal, in the present example its drain, connected to a control terminal, here the gate, of transistor 108, and a control terminal, here its gate, connected to a node 118 of application of a bias potential $V_{BIAS}$.

Current source 116 is connected between the gate of transistor 108, and thus the drain of transistor 114, and rail 100.

According to an embodiment, current source 116 is controllable. In other words, current source 116 is a variable current source configured to deliver a current 1116 having its value depending on a control signal cmd1 that it receives. In embodiments, current source 116 is configured to deliver a current 1116 having its value depending on potential Vout. Preferably, current source 116 is configured to deliver a current 1116 having its value decreasing when potential Vout decreases with respect to its set point value, and having its value increasing when potential Vout increases with respect to its set point value.

Regulator 1 further comprises a circuit 120 configured to deliver signal cmd1 to current source 116. Circuit 120 is connected to rails 100 and 102 to be powered with potential Vcc. Circuit 120 comprises an input terminal 121 connected to output terminal 106 to receive potential Vout, and an output terminal 122 configured to deliver signal cmd1. Circuit 120 is configured to determine signal cmd1 from potential Vout and, preferably, from a signal representative of the set point value of potential Vout, for example, signal cmd2. Preferably, circuit 120 is configured to control current source 116 so that the value of current 1116 decreases when potential Vout decreases with respect to its set point value, and increases when potential Vout increases with respect to its set point value. Preferably, although this is not shown in FIG. 1, circuit 120 comprises an input terminal configured to receive a signal representative of the set point value of potential Vout, for example, signal cmd2.

Regulator 1 comprises a circuit 124. Circuit 124 is connected to rails 100 and 102 to be powered with potential Vcc. Circuit 124 comprises an input terminal 125 connected to terminal 104 to receive potential $V_{P\ F}$, and an output terminal 126 connected to the control terminal, here, the gate, of transistor 110. Circuit 124 is configured to deliver potential cmd2 onto the gate of transistor 110 so that potential Vout is at its set point value in steady state.

The operation in transient state of the regulator of FIG. 1 will now be described, considering, as an example, the case of a load transient corresponding to an increase in the current drawn by the loads connected to terminal 106, sufficient high and/or abrupt for the value of potential Vout to decrease with respect to its set point value.

The decrease of potential Vout corresponds to a decrease in the potential on the source of transistor 110. Since potential cmd2 on the gate of transistor 110 is constant, this causes a decrease in the gate-source voltage of transistor 110. Since current 1112 is constant, this causes a decrease in a potential V1 on node 128 (source of transistor 114), and thus an increase in the gate-source voltage of transistor 114.

It is first considered that current source 116 delivers a constant current 1116. The increase in the gate-source voltage of transistor 114 thus causes a corresponding decrease in a potential V2 on the drain of transistor 114, and thus in the potential V2 delivered to the gate of transistor 108. In other words, current source 116 and transistor 114 behave as a non-inverting amplifier circuit receiving potential V1 as an input and outputting potential V2. The decrease of potential V2 causes an increase in the gate-source voltage of transistor 108, and thus an increase of potential Vout, which counterbalances the decrease of potential Vout due to the increase in the current drawn from terminal 106.

The provision of current source 116 and of transistor 114 biased by potential $V_{BIAS}$ enables to ascertain that transistor 110 remains saturated, particularly when the value of potential Vcc is relatively distant from that of potential Vout. Indeed, potential V1 may be set to a relatively low value, which would not be the case if node 128 had been directly connected to the gate of transistor 108.

However, a disadvantage from which regulator 1 would suffer if current source 116 effectively delivered a constant current 1116 is that the discharge of the gate of transistor 108 would be limited by the current 1116 delivered by current source 116. As a result, the slope with which potential Vout can increase to recover its set point value after an increase in the current drawn from terminal 106 would be limited.

In the embodiment of regulator 1 described hereabove, current 1116 decreases when potential Vout decreases. This enables to accelerate the discharge of the gate of transistor 108, and thus to increase the slope with which potential Vout increases up to its set point value after an increase in the current drawn from terminal 106. Thus, in regulator 1, current source 116 and transistor 114 behave as a non-inverting amplifier circuit receiving potential V1 as an input and outputting potential V2, the gain of which is variable or controlled and determined by the value of potential Vout.

Although the operation of regulator 1 in transient state when potential Vout decreases due to an increase in the current drawn from terminal 106 has been described hereabove as an example, it will be within the abilities of those skilled in the art to deduce therefrom the operation of regulator 1 in transient state when potential Vout increases due to a decrease in the current drawn from terminal 106. In particular, in this latter case, when source 116 delivers a current having a value depending on potential Vout, the increase in current 1116 due to the increase of potential Vout enables to charge the gate of transistor 108 more rapidly with respect to the case where current 1116 would be constant, and thus to increase the slope with which the potential decreases to recover its set point value.

To decrease the amplitude of the variations of potential Vout caused by variations of the current drawn by the loads connected to terminal 106, it could have been devised to provide an additional capacitor having a significant value, for example, a capacitance greater than or equal to 100 nF, or even greater than or equal to 1 μF, connected between terminal 106 and rail 102 to be used as a filter. However, in the case where regulator 1 would be formed, or implemented, by a single integrated circuit, that is, by a single integrated circuit chip, and where the integrated circuit would be assembled in a larger electronic system, such an additional capacitor would then be external to the integrated circuit of the regulator. An ill-intentioned person, or hacker, would then be able to obtain information relative to the elements of the electronic system powered by regulator 1, by observing the variations of potential Vout across the external capacitor and the variations of the current on output terminal 106 of regulator 1, possibly by modifying the value of potential Vcc. This is not desirable in the case where the electronic system implements secure or critical functions, for example, in the case where the electronic system is used in vehicles, for example, to implement calculation functions which are critical for the proper operation of the vehicles.

The regulator 1 of FIG. 1 enables to avoid using an external capacitor such as described hereabove, and is thus particularly adapted to power elements of a critical or secure electronic system.

In the above-described regulator 1, it may still be provided for a capacitor of low value, for example, a capacitance smaller than or equal to 100 nF, or even smaller than or equal to 10 nF, to be connected between terminal 106 and rail 102, particularly because such a capacitor may be formed in the same integrated circuit as regulator 1, and is thus not accessible to an ill-intentioned person.

However, preferably, regulator 1 comprises no capacitor, even of small value, connected between terminal 106 and rail 102, which provides a more compact integrated circuit when regulator 1 is implemented by a single integrated circuit.

It should be noted that regulator 1 may, however, be used with a filtering capacitor connected between terminal 106 and rail 102, for example, with an external filtering capacitor, for example, in cases where the electronic system containing the regulator implements no critical or secure function.

Specific embodiments of circuits 120 and 124 will now be described in relation with FIGS. 2 to 4.

Figure 2:
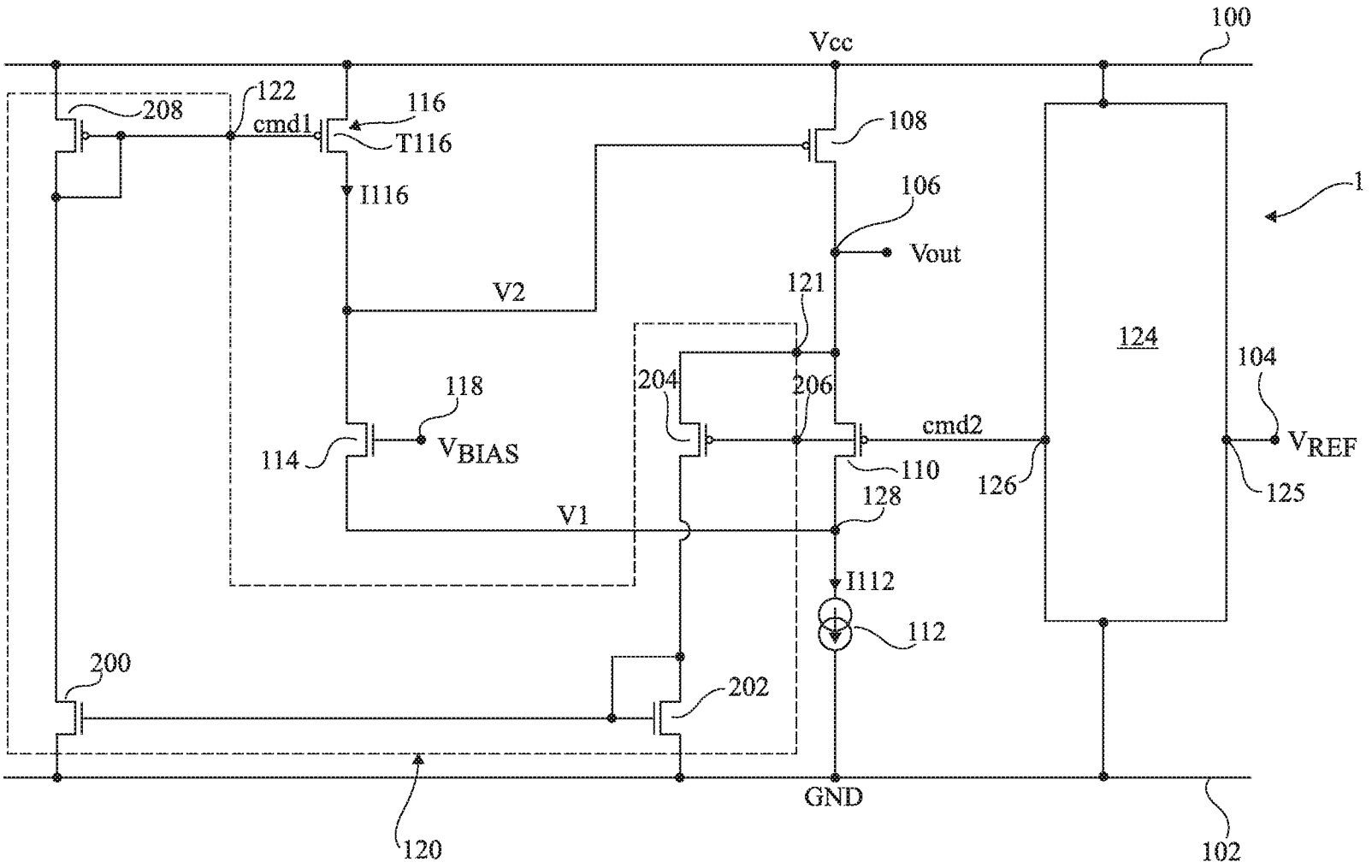
FIG. 2 shows a specific embodiment of the voltage regulator of FIG. 1.

FIG. 2 shows a specific embodiment of the voltage regulator of FIG. 1. More precisely, FIG. 2 illustrates in more detailed fashion an embodiment of the circuit 120 of the regulator 1 of FIG. 1, circuit 120 being delimited by dotted lines in FIG. 2.

Circuit 120 comprises a MOS transistor 200, preferably an NMOS transistor, connected in a current mirror configuration with a MOS transistor 202, preferably, an NMOS transistor. In other words, the control terminals of transistors 200 and 202, here their gates, are interconnected, and a conduction terminal of transistor 202, here its drain, is connected to its control terminal. The other conduction terminal of transistor 202, here its source, is connected to rail 102, a corresponding conduction terminal of transistor 200, here its source, being also connected to rail 102.

Circuit 120 further comprises a MOS transistor 204, preferably a PMOS transistor, connected between output terminal 106 and transistor 202. In other words, transistor 204 is series-connected with transistor 202, between terminal 106 and rail 102. Still in other words, a conduction terminal of transistor 204, here its source, is connected to output terminal 106, and another conduction terminal of transistor 204, here its drain, is connected to the drain of transistor 202.

The control terminal of transistor 204, here its gate, is connected to an input terminal 206 of circuit 120 configured to receive a signal representative of the set point value of potential Vout, in the present example signal cmd2. In other words, in the present example, the gate of transistor 204 is connected to the gate of transistor 110.

Circuit 120 comprises a MOS transistor 208, preferably a PMOS transistor. Transistor 208 is series-connected with transistor 200, between rails 100 and 102. More particularly, a conduction terminal of transistor 208, here its drain, is connected to the drain of transistor 200, and another conduction terminal of transistor 208 is connected to rail 100.

In this embodiment of regulator 1, current source 116 comprises a MOS transistor T116, preferably a PMOS transistor, current source 116 being preferably formed by transistor T116. Transistor T116 is then connected between rail 100 and the gate of transistor 108 and has its gate connected to the gate of transistor 208. In other words, transistor T116 has a first conduction terminal, here its source, connected to rail 100, and a second conduction terminal, here its drain, connected to the gate of transistor 108, and thus to the drain of transistor 114. Further, transistor T116 is connected in a current mirror configuration with transistor 208, transistor 208 then having its drain connected to its gate. Thus, the gate of transistor 208 forms the output terminal 122 of circuit 120 and potential cmd1 is available on the gate of transistor 208.

Circuit 120 operates as follows in the transient state. The case where the transient state corresponds to a decrease of potential Vout with respect to its set point value due to an increase in the current drawn from terminal 106 is here considered as an example. It will be within the abilities of those skilled in the art to adapt the above-described operation to the case where potential Vout increases with respect to its set point value due to a decrease in the current drawn from terminal 106.

During a decrease of potential Vout with respect to its set point value, transistor 204, which here has the same gate-source voltage as transistor 110, behaves like transistor 110. The decrease of potential Vout thus causes a decrease in the potential on the gates of transistors 200 and 202, and thus a decrease in their gate-source voltages. The decrease in the gate-source voltage of transistor 200 causes an increase of potential cmd1. As a result, the current 1116 delivered by source 116 decreases, which enables to accelerate the discharge of the gate of transistor 108 with respect to the case where current 1116 would have been constant.

Figure 3:
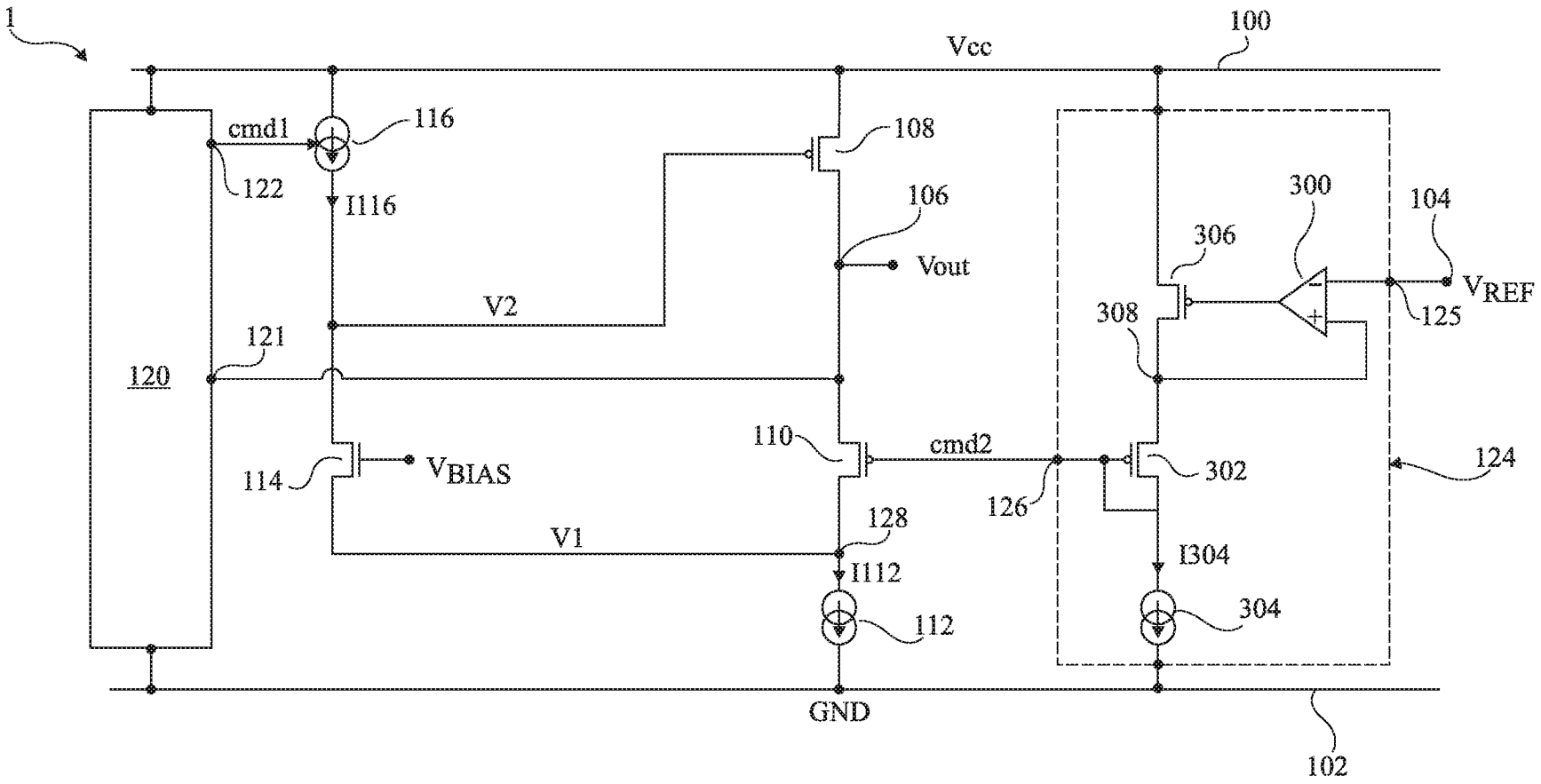
FIG. 3 shows another specific embodiment of the voltage regulator of FIG. 1.

FIG. 3 shows another specific embodiment of the voltage regulator of FIG. 1.

More precisely, FIG. 3 illustrates in more detailed fashion an embodiment of circuit 124 of the regulator 1 of FIG. 1, circuit 124 being delimited by dotted lines in FIG. 3.

Circuit 124 comprises an operational amplifier 300 having a first input, in the present embodiment the inverting input (−), configured to receive the signal or potential representative of the set point value of potential Vout, in the present example, potential $V_{REF}$, delivered to input terminal 125 of circuit 124. In other words, the first input of amplifier 300 is connected to terminal 125.

Circuit 124 comprises a MOS transistor 302, preferably a PMOS transistor. A conduction terminal of transistor 302, in the present example, its drain, is coupled to rail 102 via a current source 304. In other words, the drain of transistor 302 is connected to a terminal of current source 304, the other terminal of current source 304 being connected to rail 102. Another conduction terminal of transistor 302 is connected to the second input of amplifier 300, that is, the non-inverting input (+) in this embodiment. The control terminal of transistor 302, here its gate, is configured to deliver signal cmd2. In other words, the gate of transistor 302 is connected to the output terminal 126 of circuit 124, and thus to the gate of transistor 110.

In this embodiment, the gate of transistor 302 is connected to the conduction terminal of transistor 302 arranged on the side of current source 304, that is, here, the drain of transistor 302.

In this embodiment, circuit 124 comprises a MOS transistor 306, preferably a PMOS transistor. Transistor 306 is series-connected with transistor 302 and source 304, between rails 100 and 102, transistor 306 being connected to rail 100. More particularly, a conduction terminal of transistor 306, in the present example its source, is connected to rail 100, the other conduction terminal of transistor 306, in the present example its drain, being connected to the non-inverting input of amplifier 300 and to transistor 302, here to the source of transistor 302. The control terminal of transistor 306 is connected to the output of amplifier 300.

To illustrate the operation of circuit 124, the following case is considered as an example: transistors 302 and 110 are identical, or, in other words, have the same channel width W and the same channel length L; source 304 is configured to deliver, in steady state, a current 1304 of same value as that of the current flowing through transistor 110; and the set point value of potential Vout is equal to the value of potential $V_{REF}$.

Amplifier 300 imposes on its non-inverting input, via the transistor 306 that it controls, a potential equal to the potential $V_{REF}$ received on its inverting input. In other words, amplifier 300 and transistor 306 impose potential $V_{REF}$ on node 308 of connection between transistors 302 and 306, and thus on the source of transistor 302. Transistors 110 and 302 having the same gate potential and conducting identical currents, that is, currents having identical values, they thus have the same source potential, that is, potential $V_{REF}$. The source of transistor 110 being connected to terminal 106, potential Vout is then equal to potential $V_{REF}$.

The embodiment of FIG. 3 is compatible with that of FIG. 2. In other words, a regulator 1 comprising a circuit 120 such as described in relation with FIG. 2 and a circuit 124 such as described in relation with FIG. 3 may be provided.

Figure 4:
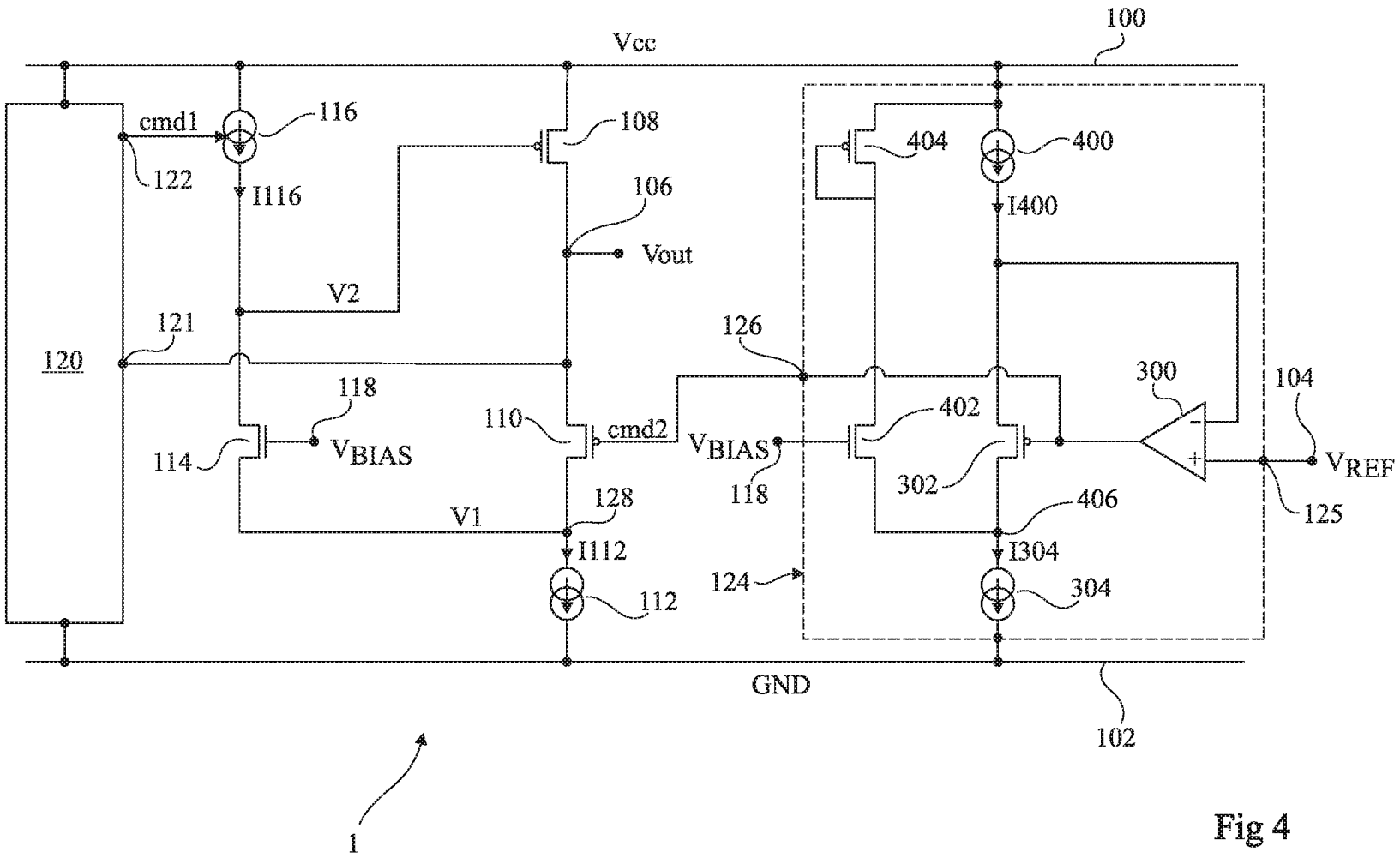
FIG. 4 shows still another specific embodiment of the voltage regulator of FIG. 1.

FIG. 4 shows still another specific embodiment of the voltage regulator of FIG. 1. More precisely, FIG. 4 illustrates in more detailed fashion another embodiment of the circuit 124 of the regulator 1 of FIG. 1, circuit 124 being delimited by dotted lines in FIG. 4.

Like the circuit 124 described in relation with FIG. 3, the circuit 124 of FIG. 4 comprises: operational amplifier 300, having its first input, in the present embodiment, the non-inverting input (+), configured to receive the signal or potential representative of the set point value of potential Vout, in the present example, potential $V_{REF}$, delivered to the input terminal 125 of circuit 124; and MOS transistor 302, preferably a PMOS transistor, having a conduction terminal, here its drain, coupled to rail 102 via current source 304, and having its other conduction terminal connected to the second input of amplifier 300, that is, the inverting input (−) in this embodiment, the control terminal of transistor 302, here its gate, being connected to the output terminal 126 of circuit 124, and thus to the gate of transistor 110.

In this embodiment, the drain of transistor 302 is not connected to its gate. Further, the gate of transistor 302 is connected to the output of amplifier 300.

In this embodiment, the inverting input (−) of amplifier 300 and thus the source of transistor 302, are coupled to rail 100 via a current source 400. Current source 400 is configured to deliver a constant current 1400. In other words, the source of transistor 302 is connected to terminal of current source 400, the other terminal of current source 400 being connected to rail 100.

In this embodiment, circuit 124 does not comprise the transistor 306 of the embodiment described in relation with FIG. 3, but comprises a MOS transistor 402, preferably an NMOS transistor, series-connected with a MOS transistor 404, preferably a PMOS transistor, between rail 100 and the drain of transistor 302. Transistor 404 is connected to rail 100, transistor 402 being connected to the drain of transistor 302. More precisely, a conduction terminal of transistor 402, here its source, is connected to the drain of transistor 302, the other conduction terminal of transistor 402, here, its drain, being connected to a conduction terminal of transistor 404, here the drain of transistor 404, and a control terminal of transistor 402 is configured to receive a bias potential. The other conduction terminal of transistor 404, here its source, is connected to rail 100.

The drain of transistor 404 is connected to the control terminal of transistor 404, here the gate of transistor 404. In other words, transistor 404 is diode-connected.

Transistor 404 plays the role of a resistive element or resistor. In alternative embodiments, transistor 404 is replaced by a resistive element.

According to an embodiment, the control terminal of transistor 402, here, its gate, is connected to node 118 of application of potential $V_{BIAs}$ or, in other words, to the gate of transistor 114.

According to an embodiment, current sources 400 and 304 are configured so that, in steady state or, in other words, when potential Vout is at its set point value, the current flowing through transistor 402 has the same value as the current flowing through transistor 114, that is, is identical to the current 1116 delivered by source 116.

According to an embodiment, current sources 400 and 304 on the one hand, and 116 and 112 on the other hand, are configured so that, in steady state, the currents flowing through the respective transistors 302 and 110 are equal or, in other words, identical.

Circuit 124 operates as follows in steady state. It is here considered as an example that transistors 302 and 110 are identical and that transistors 402 and 114 are identical.

Transistors 302 and 110 conduct identical currents and have the same gate potential cmd2, they thus have the same source potentials. Due to the fact that the source potential of transistor 302 is equal to potential $V_{REF}$ via amplifier 300, the source potential Vout of transistor 110 is thus also equal to potential $V_{REF}$.

Further, transistors 402 and 114 conduct identical currents and have the same potential $V_{BIAS}$ on their gates. This imposes that the potential at node 128 (source of transistor 114) is identical to the potential on node 406 of connection between transistor 402 and transistor 302 (source of transistor 402). In other words, transistors 302 and 110 have the same drain potentials (node 128 for transistor 110 and node 406 for transistor 302).

Still in other words, in steady state, circuit 124 is configured to impose a potential on node 128 (drain of transistor 110) equal to the potential on node 406 (drain of transistor 302). More generally, in steady state, circuit 124, transistor 114, particularly the potential $V_{BIAs}$ received by the control terminal of transistor 114, and current source 116, are configured to impose a potential on node 128 (drain of transistor 110) equal to the potential on node 406 (drain of transistor 302).

The circuit 124 described in relation with FIG. 4 enables the value of potential Vout to be, in steady state, equal to a set point value, for example, the value of potential $V_{REF}$, more accurately than with the circuit 124 described in relation with FIG. 3. In other words, the circuit 124 of FIG. 4 enables, in steady state, to better control the gain between potential $V_{REF}$ and potential Vout than the circuit 124 of FIG. 3. This particularly results from the fact that the circuit 124 of FIG. 4 enables to set the drain potential of transistor 110 with respect to the drain potential of transistor 302, more accurately than with the circuit 124 of FIG. 3 and, more particularly, to ascertain that the drain potential of transistor 302 is here equal to the drain potential of transistor 110.

The embodiment of FIG. 4 is compatible with that of FIG. 2. In other words, a regulator 1 comprising a circuit 120 such as described in relation with FIG. 2 and a circuit 124 such as described in relation with FIG. 4 may be provided.

An embodiment of a circuit 124 in the case of a regulator 1 having its current source 116 delivering a variable current 1116 has been described hereabove in relation with FIG. 4. In other embodiments, it may be provided for the circuit 124 of FIG. 4 to belong to a regulator which differs from that of FIG. 4 in that its source 116 delivers a constant current 1116 and in that it comprises no circuit 120. The advantages of circuit 124 relative to the accuracy, in steady state, of the value of potential Vout with respect to its set point value apply to such a regulator having its current source 116 delivering a constant current 1116.

In such embodiments where source 1116 delivers a constant current, when element 404 is a diode-connected transistor as shown in FIG. 4, it may be provided for current source 116 to correspond to a transistor which is mirror-assembled with transistor 404. In this case, the constant current 1116 delivered by source 116 is proportional, for example, equal, to the current flowing through transistor 404.

Although an embodiment where transistors 114 and 402 are identical and receive a same potential $V_{BIAs}$ on their respective control terminals has been described in relation with FIG. 4, it will be within the abilities of those skilled in the art to adapt this embodiment to the case where transistors 114 and 402 have different dimension ratios and/or to the case where the potential received by the control terminal of transistor 114 is different from that received by the control terminal of transistor 402, while keeping the above-described operation, that is, while imposing that, in steady state, the potential of node 406 is equal to that of node 128.

In alternative embodiments, not shown, of the regulator 1 described hereabove in relation with FIGS. 1 to 4, one may provide: a capacitor connected between terminal 106 and node 128; and/or a capacitor connected between terminal 106 and the control terminals of transistors 200 and 202 (FIG. 2).

Such capacitors enable to respectively stabilize the feedback loop formed by transistors 114 and 108 and source 116 and the feedback loop formed by circuit 120 between terminal 106 and source 116. Such capacitors also allow an operation of the respective feedback loops at higher frequencies. Indeed, the capacitor connected between node 106 and node 128 enables the potential of node 128 to vary more rapidly due to a variation of potential Vout, and the capacitor connected between terminal 106 and the control terminals of transistors 200 and 202 (FIG. 2) enables the gate potential of transistors 200 and 202 to vary more rapidly due to a variation of potential Vout.

Further, although the advantages of the described embodiments and variations of regulator 1 have been indicated hereabove for load transients, such advantages also apply to the case of line transients.

Constant current sources have been previously described. The term constant current source means a current source delivering a current having a given value considered as constant, it being understood that in practice, this value may not be perfectly constant, for example, due to temperature variations, manufacturing variations, and/or variations called transient. Such constant currents are for example called bias currents.

Various embodiments and variations have been described. It will be understood by those skilled in the art that certain features of these various embodiments and variations may be combined, and other variations will occur to those skilled in the art.

Finally, the practical implementation of the described embodiments and variations is within the abilities of those skilled in the art based on the functional indications given hereabove. In particular, it will be within the abilities of those skilled in the art to size the various transistors of regulator 1, particularly transistors mirror-assembled with each other to form current mirrors, to size the current sources of the regulator, that is, to select the currents delivered by the current sources, and/or to determine the value of the potentials received by the control terminals of the respective transistors 402 and 114. As an example, it will be within the abilities of those skilled in the art to provide different surface area ratios for transistors described as identical in the above examples, for example, by adapting the currents delivered by the various currents sources and/or the value of the bias potential applied to the gate of transistor 114 and/or the value of the bias potential applied to the gate of transistor 402.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

The invention claimed is:

1. A device, comprising:

a first current source;

a first transistor connected between a first supply rail and an output terminal;

a second transistor connected between the output terminal and a first terminal of the first current source, wherein a second terminal of the first current source is connected to a second supply rail; and a variable-gain amplifier circuit configured to apply a first potential to a control terminal of the first transistor in response to a second potential at the first terminal of the first current source, wherein a gain of the variable-gain amplifier circuit is determined by a third potential at the output terminal.

2. The device of claim 1, wherein the variable-gain amplifier circuit comprises:

a third transistor connected between the first terminal of the first current source and the control terminal of the first transistor; and a second current source connected between the first supply rail and the control terminal of the first transistor, the second current source being configured to deliver a variable current having a value depending on the third potential at the output terminal.

3. The device of claim 2, wherein a control terminal of the third transistor is connected to a node of application of a bias potential.

4. The device of claim 2, further comprising a first circuit configured to apply a control signal to the second current source, wherein the control signal applied to the second current source is based on the third potential at the output terminal.

5. The device of claim 4, wherein the first circuit comprises:

a fourth transistor connected in a current mirror configuration with a fifth transistor;

a sixth transistor connected to the output terminal and in series with the fifth transistor, wherein a control terminal of the sixth transistor is connected to a control terminal of the second transistor; and a seventh transistor series-connected with the fourth transistor between the first supply rail and the second supply rail.

6. The device of claim 5, wherein the second current source comprises an eighth transistor connected in a current mirror configuration with the seventh transistor.

7. The device of claim 1, further comprising a second circuit configured to apply a control signal to the second transistor.

8. The device of claim 7, wherein the second circuit is configured to determine the control signal applied to the second transistor based on a set point value for the third potential at the output terminal.

9. The device of claim 8, wherein the second circuit comprises:

an operational amplifier having a first input configured to receive a reference potential representative of said set point value; and a ninth transistor having a first conduction terminal coupled to the second supply rail via a third current source, wherein the ninth transistor has a second conduction terminal connected to a second input of the operational amplifier, and has a control terminal configured to apply the control signal to the second transistor.

10. The device of claim 9, wherein the second circuit further comprises:

a tenth transistor having a first conduction terminal connected to the second conduction terminal of the ninth transistor, a second conduction terminal connected to the first supply rail and a control terminal connected to an output of the operational amplifier.

11. The device of claim 10, wherein the control terminal of the ninth transistor and the first conduction terminal of the ninth transistor are interconnected, and wherein the first input of the operational amplifier is an inverting input.

12. The device of claim 9, wherein the second circuit further comprises:

a fourth current source connected between the second conduction terminal of the ninth transistor and the first supply rail; and a tenth transistor and a resistive element series-connected between the first conduction terminal of the ninth transistor and the first supply rail, wherein a control terminal of the tenth transistor is configured to receive a bias potential that is also applied to a control terminal of a third transistor, and wherein a conduction terminal of the tenth transistor is connected to the first conduction terminal of the ninth transistor.

13. The device of claim 12, wherein the resistive element comprises a diode-connected transistor.

14. The device of claim 9, wherein the second circuit is configured to impose a same potential on the first terminal of the first current source and on the first conduction terminal of the ninth transistor.

15. The device of claim 1, forming a voltage regulator.

16. The device of claim 1, implemented by a single integrated circuit.

17. The device of claim 16, wherein the device comprises no capacitor connected between the output terminal and the second supply rail.

18. The device of claim 1, further comprising a conductive path coupling the output terminal to an input terminal of the variable-gain amplifier circuit, wherein the conductive path is separate from the second supply rail.

19. A device, comprising:

a first transistor having a first current conduction path connected between a first supply rail and an output terminal;

a second transistor having a second current conduction path connected between the output terminal and a first intermediate node;

a first current source having a third current conduction path connected between the first intermediate node and a second supply rail;

a second current source having a fourth current conduction path connected between the first supply rail and a control terminal of the first transistor;

a third transistor having a fifth current conduction path connected between the control terminal of the first transistor and the first intermediate node; and a sixth current conduction path connected between the output terminal and a control terminal of the second current source controlling a magnitude of current being output from the second current source.

20. The device of claim 19, wherein a control terminal of the third transistor is biased by a bias voltage.

21. The device of claim 19, further comprising a circuit configured to control the second current source in response to a voltage at the output terminal.

22. The device of claim 19, wherein the second transistor has a control terminal configured to receive a control signal and further comprising a circuit configured to generate the control signal in response to a reference voltage.

* * * * *